US006305863B1

(12) United States Patent
Gueret

(10) Patent No.: US 6,305,863 B1
(45) Date of Patent: Oct. 23, 2001

(54) DISPENSING AND APPLICATOR ASSEMBLY WITH SELF-LOADING APPLICATOR

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/503,850

(22) Filed: Feb. 15, 2000

(30) Foreign Application Priority Data

Feb. 16, 1999 (FR) ..... 99 01868

(51) Int. Cl.[7] ..... A46B 11/00
(52) U.S. Cl. ..... 401/126
(58) Field of Search ..... 401/126–130, 401/120, 125

(56) References Cited

U.S. PATENT DOCUMENTS 4,515,298 * 5/1985 Czech ..... 222/380
4,752,147 6/1988 Persi .
5,492,426 * 2/1996 Gueret ..... 401/126

FOREIGN PATENT DOCUMENTS 0 264 824 4/1988 (EP) .
0 612 488 8/1994 (EP) .
0 743 263 11/1996 (EP) .
0 500 020 2/1939 (GB) .
2 084 455 4/1982 (GB) .

OTHER PUBLICATIONS

English language Derwent Abstract of EP 0 264 824.
English language Derwent Abstract of EP 0 612 488.
English language Derwent Abstract of EP 0 743 263.

* cited by examiner

*Primary Examiner*—Timothy L. Maust
*Assistant Examiner*—Peter deVore
(74) *Attorney, Agent, or Firm*—Finnegan, Henderson, Farabow, Garrett & Dunner, LLP

(57) ABSTRACT

An assembly for dispensing and applying a product, such as a cosmetic product, includes a first portion defining a reservoir having a varying volume and containing the product to be dispensed. A flow passage and a one-way valve selectively establish flow communication between the reservoir and the space. The space is configured to removably receive an application member receiving the product to be applied. The space is closed by a cap removably mounted on the second portion. A piston slidably disposed within the second space causes a pressure decrease inside the second space, which opens the one-way valve and causes the product to flow from the reservoir to the space via the flow passage.

68 Claims, 5 Drawing Sheets

DISPENSING AND APPLICATOR ASSEMBLY WITH SELF-LOADING APPLICATOR

The present invention relates to an assembly for storing, dispensing, and applying a product, such as, for example, a cosmetic product. In particular, the invention may be used for products in the form of a liquid, a gel, or a cream. By way of example only, use of the present invention for storing, dispensing, and applying products, such as skin-care or hair-care products, make-up removers, or hair-coloration products will be described.

In the field of cosmetics in particular, certain products, for example in the form of a milk, a cream or a gel, are dispensed under pressure by a pump. Because of their instability in the presence of air, these products may be packaged in pump systems of the airless type. That is, the products are packaged under vacuum in a reservoir having a volume that decreases as the product is pumped from the reservoir. Typically, the reservoir is made of a bag with collapsible walls, a tube with deformable or bellowed walls, or a bottle in which a follower piston is disposed. The pump may be a pump of the type with a piston, a diaphragm or a shutter valve.

To apply the product, a user takes the pumped-out product onto one or more of her fingers and applies it by rubbing it in to the surface to be treated. Alternatively, the product may be applied using an applicator, such as, for example an applicator in the form of an open-cell foam.

In the case of a reusable applicator, i.e., an applicator that is used throughout the life of the product, it often is desirable for the applicator to be stored, between uses, out of contact with the air so that its mechanical properties, for instance, those of flexibility or absorption, are not adversely affected. Furthermore, in the case of an applicator which is not cleaned after each use, contact between the product remaining on the applicator and the ambient air, or any other element in the environment in which it is kept, carries the risk of soiling the applicator and of adversely affecting the product it contains. Carrying these applicators around, especially in a user's handbag or the like, may exacerbate many of these problems.

Finally, in the case of certain applicators, the shape of which is suited to the profile of the surface which is to be treated, for example the outline of the lips or the corners of the eyes, it is preferable for the product always to be deposited onto the applicator in the same way and in the same quantity so that application of the product is essentially repeatable from one application to the next.

European patent, EP 0,612,488, in the name of the applicant discloses a dispensing assembly in the form of a reservoir containing a product that is to be applied. A cap closes the reservoir and an applicator holder supports a deformable applicator element, made, for example, of foam or of an elastomer of low hardness. The reservoir is bounded by a capillary end piece in the shape of a thimble, the closed end of which has a seat pierced with at least one capillary orifice in which the deformable element rests and is deformed when the reservoir is closed by the cap. A device of this kind is most suitable for very liquid fluids or for powders. In the case of a cream, however, bringing the cream into contact with the capillary orifices presents difficulties. Furthermore, the presence of a volume of air above the free surface of the product may be detrimental to the properties of certain products, particularly their cosmetic properties.

It is one of the objects of the invention to provide a dispensing assembly which solves all or some of the problems discussed hereinabove with reference to the conventional devices.

A particular object of the invention is to provide a device which is capable of dispensing high-viscosity products, for example those in the form of creams and the like.

Yet another object of the invention is to allow an application member to be laden precisely and reproducibly with product so that repeatable applications of the product can be achieved.

Still further objects will become clear from the detailed description which follows. It should be understood that the invention could still be practiced without performing one or more of the preferred objects or advantages described herein.

According to the invention, the objects of the invention are achieved by an assembly for dispensing a product, such as, for example, a cosmetic product, comprising a first portion defining a reservoir containing the product. The volume of the reservoir decreases in response to removal of the product from the reservoir. The assembly further includes a second portion defining a space to removably receive an application member. A flow passage provides flow communication between the reservoir and the space and a flow valve selectively enables flow of the product from the reservoir to the space via the flow passage. A removable cap is disposed on the second portion and a piston causes a pressure decrease in the space. The valve opens in response to the pressure difference in the space to enable flow of at least a portion of the product from the reservoir to the space via the flow passage.

Thus, when the cap is fitted onto the second portion, the application member is arranged in a predetermined way with respect to the product flow passage, which can have the form of a outlet orifice, preferably resting elastically against the flow passage, which allows it to be more precisely laden, both with respect to the amount of product withdrawn and to the location of the product on the applicator. Between consecutive applications, the application member is preferably kept out of contact with the air, which allows it to maintain desirable mechanical properties, particularly its flexibility. Furthermore, any product that remains on the applicator may be prevented from becoming adversely affected in the presence of the air or from soiling the environment in which the assembly is stored.

Regardless of the viscosity, the product can be moved from the reservoir to the space in response to a pressure decrease generated by the relative movement of the piston within the space. The volume of product that can be absorbed by the application member preferably is greater than or equal to the volume pumped out of the reservoir in response to the displacement of the piston. It is, however, possible to arrange for the volume that can be absorbed by the application member to be smaller than the volume of product pumped out of the reservoir. In the latter case, it is possible, as will be seen in detail later, to make the piston disengageable, so as to be able to withdraw the excess product not pumped out by motion of the piston without having to withdraw product from the reservoir to the space again.

Preferably, the application member and piston are secured to the cap and the piston generates the pressure decrease inside the space by moving from a first position into a second position when the cap is opened. The cap thus forms a member for grasping hold of the application member. In a single action, it is possible both to open the space and to load the application member with product, and to do so in a repeatable and consistent manner. The application member may, in an unstressed condition, have a cross-section which exceeds the cross-section of the piston.

In a preferred embodiment, a mechanism is provided, in response to a pressure increase within the space (for example, when the cap is closed onto the space), to vent the space to atmospheric pressure. The presence of the one-way flow valve (that is, a valve which opens only under the effect of a pressure decrease in the space with respect to the pressure in the reservoir) between the reservoir and the space prevents any air introduced into the space from entering the reservoir. It is contemplated that the mechanism allowing the space to be vented to atmospheric pressure may be formed of a second one-way vent valve provided within a vent passage. The vent valve preferably will be in the form of either a shutter valve or a ball valve. However, other suitable like flow control mechanisms may be provided and are considered within the scope of the invention.

According to another preferred embodiment, the second portion forming the space includes, on at least part of its height, a cylinder in which the piston slides. The height of this cylindrical portion depends to a large extent on the desired stroke of the piston and on the amount of product that is to be dispensed from the reservoir. The bottom of the space, which houses the applicator and in which the product outlet orifice is formed, preferably may be in the shape of a hemispherical cup, so that the applicator can, for example when the cap is fitted onto the second portion, come into close, and preferably elastic contact, with this surface portion, and become evenly laden with product.

The assembly may have any shape. Preferably, the reservoir containing the product may have an oval cross section, while the space containing the application member may have a circular cross-section. Alternatively, the space containing the application member also may have an oval cross-section. In this case, the cap is closed onto the assembly by a closure system having one or more ramps, commonly referred to as a twist closure. Other shapes and combinations of shapes may be contemplated and are considered to be within the scope of this invention.

The piston may be provided as a non-porous portion of the applicator. Thus, the applicator may be formed of several different materials: (i) a porous material, preferably one made of open-cell foam or the like, in the case of that part of it which is intended to be in contact with the product outlet orifice from the reservoir and to apply the product via an application surface, and (ii) an impervious material, preferably one made of closed-cell foam or the like, forming a part of the applicator which is distant from the reservoir outlet orifice and not used directly for applying product to the surface that is to be treated.

According to yet another preferred embodiment, the piston is formed as a separate element from the application member, the piston being secured to the application member and arranged on the side of the application member opposite to the outlet orifice. Preferably, the piston element is made of an elastomeric material, or other like material.

Preferably, passing through the piston is at least one passage capable of allowing the space to be vented to atmospheric pressure. This makes it possible, in combination with the one-way vent valve, to place the space containing the application member at atmospheric pressure, thus avoiding any raised pressure, which tends to occur when the application member and piston are returned into the space after use.

According to yet another preferred embodiment, an annular space is formed between the space and the cap. The annular space is in flow communication with the space and the piston is arranged in the annular space.

Thus, the piston may be secured to an element which, at least in part, delimits the said space and forms a lip configured to slide when the cap is opened in a sealed fashion against an interior surface of a lateral skirt formed by the cap. The piston may be obtained by two-shot injection molding or by overmolding with the element forming the space, or by other suitable like methods.

Preferably, the lip is oriented such that when the pressure decreases inside the space, it rests in a sealed fashion against the interior surface of the skirt and, when the pressure increases inside the space, it does not rest in a sealed fashion against the interior surface. Such a configuration allows the space to be vented to atmospheric pressure. Thus, when the cap is put back on to the second portion to close the space, an increase in pressure is generated in the space causing the lip of the piston to move away from the interior surface of the cap. This breaks the seal and allows atmospheric pressure to be re-established inside the space. The pressurized air escapes between the piston and the interior surface of the cap, and then is discharged under the free edge formed by the lateral skirt of the cap.

The piston also may be disengageable so that, in the disengaged position, it does not generate a pressure decrease inside the space in response to movement of the piston between the first and second positions. In this embodiment, a mechanism accessible from outside the assembly is provided to selectively cause the piston to move from a disengaged position into an engaged position and vice versa. Thus, in the event that the application member does not fully absorb the product in the space, it is possible to reinsert the application member into the space without having to put the cap back on. Thus, a user can refill the application member with product without dosing more product from the reservoir into the space. Such a disengageable piston preferably may consist of an elastically deformable member, for example a member which is deformable by being compressed. In an uncompressed position, the piston preferably has a smaller cross-section than the cylinder in which it slides. This uncompressed configuration corresponds to the disengaged position of the piston. In the compressed configuration, the piston preferably has a larger cross-section than the cylinder and slides in a sealed fashion inside the cylinder. This compressed configuration corresponds to the engaged position of the piston.

The assembly according to the invention may be formed of a rigid or semi-rigid body, preferably made of polyethylene or polypropylene or other suitable like material, and comprising a transverse wall defining the flow passage, for example in the form of at least one outlet orifice. The space preferably is defined by a first skirt portion of the assembly body, a free edge of which delimits a first opening.

The free edge of the first skirt portion may have a screw thread configured to engage a corresponding screw thread on the removable cap. This type of closure allows the space to be sealed tightly. Sealing can be further improved by the presence of auxiliary means, preferably in the form of a sealing skirt or gasket, or the like.

The piston can be arranged outside the first skirt portion and be secured to the first skirt portion. Production of the application member and, in particular, the structure which supports it, is thereby facilitated in so far as it is not necessary to attach an auxiliary piston to it.

The portion delimiting the reservoir is arranged on the side of the transverse wall opposite to the first skirt portion. Preferably, the reservoir is formed of a second skirt portion on the body and having a free edge located opposite to the free edge of the first skirt portion. In a preferred embodiment, a follower piston is slidably mounted inside the second skirt portion. Thus, the volume of the reservoir decreases as the product inside the reservoir is removed.

Alternatively, the follower piston is replaced by a deformable diaphragm, preferably an elastically deformable diaphragm. An example of a device of the type including an elastically deformable diaphragm is described in patent application EP-A-0,743,263, which discloses an elastic diaphragm forming the bottom of a rigid container on which a pump and a push-button are mounted. The diaphragm is fixed along its periphery to the wall of the rigid container and is initially flat in shape or slightly concave or convex towards the product. As the product is used, the diaphragm can deform elastically over an axial height of approximately 15 mm to approximately 20 mm for example, so as to hug the shape of the inside of the container. A design of this kind, on account of its shape, makes it possible to give the application member a larger surface area, thus facilitating the application of the product to larger areas of the body, such as, for example, the bust or the thighs.

According to another preferred embodiment of the invention, the reservoir is formed of a flexible bag with collapsible, flexible walls mounted on the rigid portion of the assembly. A bag of this kind may include a complex of several materials, for example metallic and/or thermoplastic materials. Preferably, the open edge of the bag is welded to the rigid portion. The bottom of the bag is closed along a line of welding or bonding, or other suitable closing method.

As a preference, a bag of this kind is arranged inside a rigid or semi-rigid chamber, and a mechanism, such as an orifice or a shutter valve, allows air to be taken into the space defined between the rigid or semi-rigid chamber and the flexible bag.

The application member may at least in part be formed of at least one block of an open-cell or semi-open-cell foam, of felt or of a frit, or other suitable like material configured to absorb the product to be dispensed and applied.

By way of examples, at least a portion of application member is made of a material selected from polyether, polyester, polyurethane, NBR (Natural Butadiene Rubber), SBR (Synthetic Butadiene Rubber), PVC (Polyvinyl Chloride), latex or silicone foam, or of a frit of plastic, such as polyethylene or nylon, or a frit of metal, such as, for example bronze, or a glass frit.

When the cap is fitted, the application member preferably rests elastically against the outlet orifice or orifices. Thus, in the case of an application member made of compressible material, the application member is dimensioned such that when the cap is fitted, the application member is at least partially compressed. The time period during which the application member is in contact with the product pumped into the second space is thereby extended. Furthermore, this arrangement encourages the pumping of the product by the application member as the application member decompresses. Finally, the application member can be reladen with product without having to screw the cap back onto the reservoir, or to otherwise dose more product from the reservoir to the space.

Assuming that the application member is made of a material which is not particularly compressible, for example a felt or a frit, an elastically compressible element preferably is arranged between the application member and the piston. An element of this kind may consist of a block of elastomeric material or of a block of open-cell or closed-cell foam, or other suitable like material.

According to yet another embodiment of the invention, the assembly for dispensing includes a first portion defining a reservoir configured to contain the product prior to dispensing. A second portion defines a space, which is in selective flow communication with the reservoir. An opening enables access to the space. A cap is configured to be removably mounted on the second portion to sealably cover the opening. An actuator also is provided to selectively cause a pressure difference between the reservoir and the space in response to removal of the cap from the second portion, wherein the pressure difference causes the product to flow from the reservoir to the space.

According to another embodiment of the present invention, an assembly for dispensing a product includes a first portion defining a reservoir containing the product to be dispensed and a second portion defining a space in selective flow communication with the reservoir. An application member for applying the product to a surface is removably disposed in the space. The application member is configured such that removal of the application member from the space induces flow of the product from the reservoir to the space, thereby permitting the application member to receive the product.

According to yet another embodiment, the present invention includes a method for dispensing a product. The method includes providing an assembly defining a reservoir containing the product, a space in selective flow communication with the reservoir, an opening permitting access to the space, a removable cap configured to sealably close the opening, and an actuator. The method further includes removing the cap to permit access to the opening, actuating the actuator to cause a pressure difference between the reservoir and the space, and causing the product to flow from the reservoir to the space as a result of the pressure difference.

The assembly according to the embodiments of the present invention is preferably used for dispensing cosmetic products and care products, such as, for example, a product in the form of a liquid, a gel or a cream. In its broadest aspects, however, the assembly of the present invention could be used for many other different types of products.

Apart from the aspects of the invention set out hereinabove, the invention includes a certain number of other aspects which will be explained hereinafter with regard to nonlimiting embodiments described with reference to the appended Figures, among which:

By way of preliminary comment, the elements which are common to the various embodiments, which will now be described in detail, are referenced where possible using the same reference numbers.

Figure 1A:
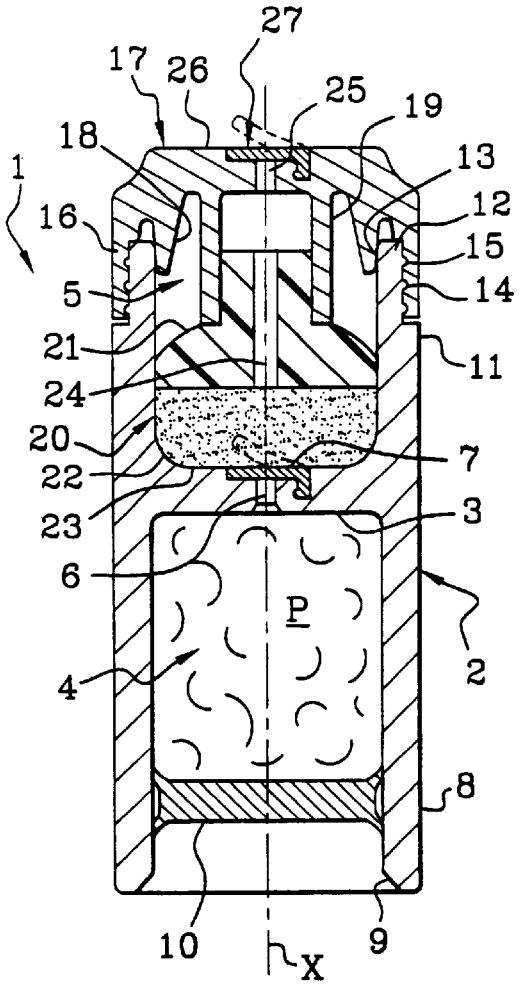
FIGS. 1A–1C are cross-sectional views of a first embodiment of an assembly according to the present invention.
Figure 1C:
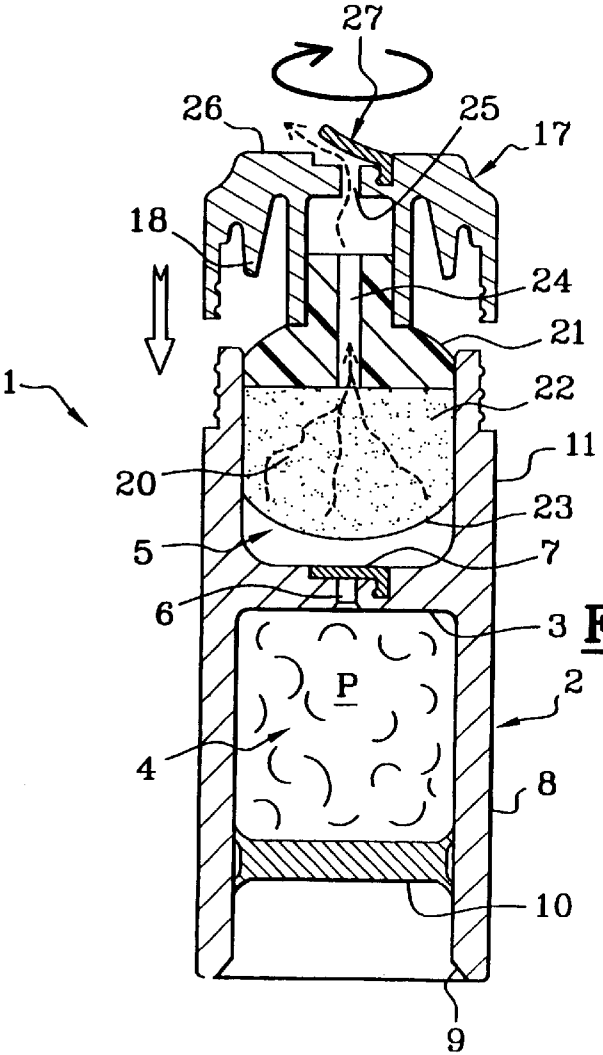
Figure 1B:
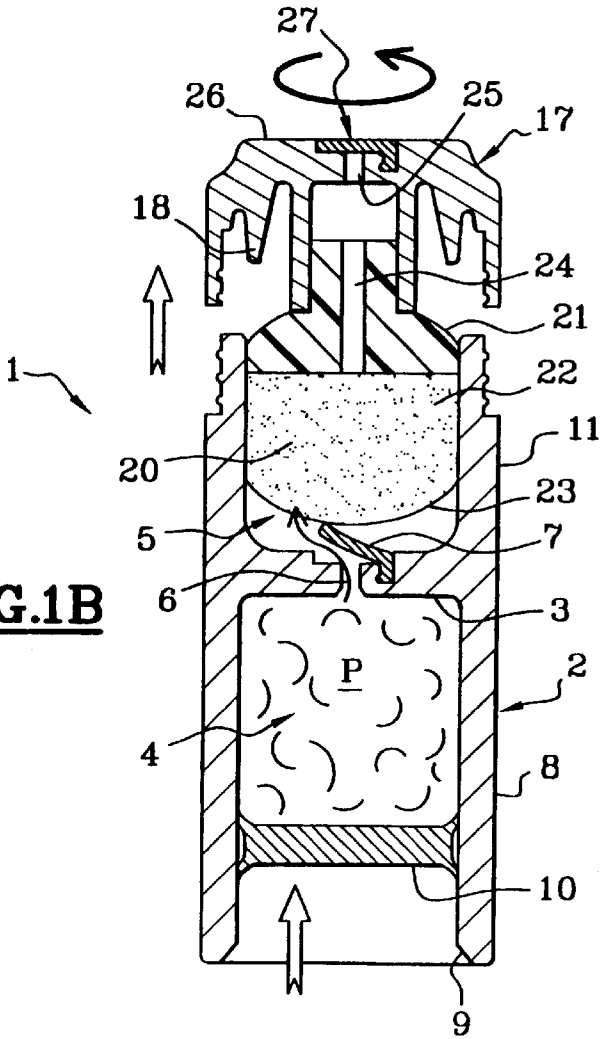

As depicted in FIGS. 1A–1C, a dispensing assembly 1 according to an embodiment of the invention comprises a cylindrical body 2 made of polypropylene and having a cross-section of virtually any shape, preferably a circular, oval or elliptical shape. Cylindrical body 2 delimits a reservoir 4 and a space 5. Reservoir 4 and space 5 are respectively disposed on opposite sides of a transverse wall 3. Transverse wall 3 has passing through it a flow passage, in the form of an orifice 6, which allows reservoir 4 to communicate with space 5 via a one-way opening shutter valve or other type of valve 7. Shutter valve 7 consists of an elastic lip, a peripheral portion of which is secured to transverse wall 3. The rest of the lip is free so that, in response to a pressure decrease inside space 5 with respect to reservoir 4, it can move away from the seat formed by the transverse wall 3. The open position of the shutter valve 7 is depicted by the dotted line in FIG. 1A. Shutter valve 7 preferably is made of an elastomeric material, such as natural or synthetic rubber, or other suitable like material.

Reservoir 4 is delimited by a lateral skirt 8, one end 9 of which is open. End 9 is disposed opposite to the end including transverse wall 3. Mounted so that it can slide in sealed fashion inside skirt 8 is a piston 10 capable, in response to a decrease in volume of reservoir 4, of rising up inside skirt 8, so as to follow the product P located between the piston 10 and the transverse wall 3. The open end 9 of skirt 8 may be closed off by an attached bottom (not depicted), pierced with an air intake orifice. The product P may, in particular, be a cream, a powder or a body lotion.

Figure 6:
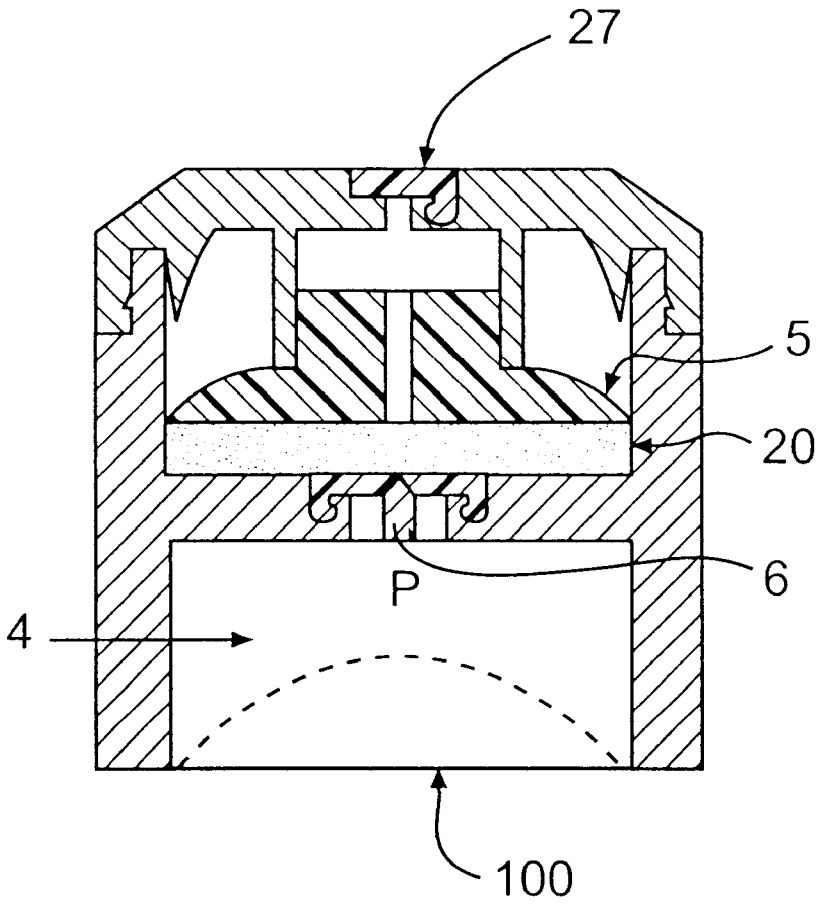
FIG. 6 is a cross-sectional view of a sixth embodiment of an assembly according to the invention wherein the piston of the embodiments of FIGS. 1A–1C is replaced with an elastically deformable diaphragm.

In an alternative embodiment, piston 10 is replaced with an elastically deformable diaphragm or membrane 100, as shown in FIG. 6. Deformable membrane 100 essentially deforms elastically to expand within skirt 8 as product P is removed from reservoir 4 (shown by the dotted lines in FIG. 6). When all of the product has been delivered, membrane 100 is squeezed agains the inner wall of skirt 8.

Space 5 is defined by a lateral skirt 11 directed away from skirt 8, a free edge 12 of which defines an opening 13. The interior wall of skirt 11 forms a cylinder over a substantial part of its height. The exterior surface of skirt 11 has, near its free edge 12, a screw thread 14 capable of engaging with a corresponding screw thread 15 formed on the interior surface of a lateral skirt 16 of a removable cap 17.

Cap 17 has a sealing skirt 18 configured to rest in a sealed fashion against the interior surface of skirt 11, so as to improve the seal achieved when cap 17 is closed using screw thread 15. Cap 17 also forms an axial tube 19 into which an applicator 20 is force-fitted (or bonded). In this embodiment, applicator 20 comprises a part 21 with closed cells which engages inside axial tube 19. The peripheral edge of part 21 is capable of sliding in sealed fashion against the interior surface of skirt 11, essentially functioning as a piston. Applicator 20 also comprises a portion 22 preferably made of an open-cell or semi-open-cell foam material, which absorbs product P contained in reservoir 4 when the product is pumped into space 5 as applicator 20 moves away from orifice 6. Portion 22 may be bonded to portion 21 or may be obtained by molding with portion 21. Applicator 20 is dimensioned in such a way that, when cap 17 is fitted as illustrated in FIG. 1A, portion 22 of applicator 20 is at least partially compressed. Portion 22 of applicator 20 includes an application surface 23, located on the side opposite to piston 21. When cap 17 is fitted, application surface 23 is in close contact with or even resting elastically on shutter valve 7.

Closed-cell portion 21 defines a duct 24 through its center which opens, at one end, into open-cell portion 22 of the applicator 20 and, at the other end, adjacent to a vent passage 25 made in an upper wall 26 of cap 17. Vent passage 25 is closed off by a one-way opening valve 27, which can have a similar structure as valve 7 and is capable of opening to the outside (refer to the position shown with dotted lines) in response to a pressure increase inside space 5.

When cap 17 is opened and removed, piston 21 moves in sealed fashion against the interior wall of the skirt 11, starting at a first position illustrated in FIG. 1A (the position in which the cap is closed) and passing through a position (close to the position of FIG. 1B), in which the seal between the piston and the cylindrical skirt 11 is broken, before being removed.

To use the assembly according to this embodiment, a user unscrews cap 17 and pulls it axially away from assembly body 2 so as to extract applicator 20 from space 5. In so doing, portion 21 of applicator 20 slides in sealed fashion against the interior surface of the skirt 11, thus generating a pressure decrease inside space 5 as compared to reservoir 4. Under the effect of the pressure decrease, shutter valve 7 lifts from its seat, as shown in FIG. 1B, and allows product P to pass through orifice 6 and into space 5. Product P is thus placed in contact with application surface 23 and is absorbed by the porous material of which portion 22 of the applicator 20 is made. Product P can then be applied by bringing application surface 23 of applicator 20 into contact with the surface that is to be treated.

During application, if it proves necessary to reload application surface 23 with product, it is possible to reinsert applicator 20 into space 5 without having to screw cap 17 back on (because of the axial oversizing of the applicator 20 with respect to the axial height of the space 5) and place application surface 23 back in contact with any excess product which may be remaining at the bottom of space 5.

After use, the user screws cap 17 back onto threads 14 of lateral skirt 11. Any air trapped in space 5 under applicator 20 will be driven out of the device via the pores of open-cell foam portion 21 via duct 24 and orifice 25. In response, shutter valve 27 lifts off the seat formed by wall 26 of cap 17. The assembly is then ready for another dispensing and application of product P.

Figure 2:
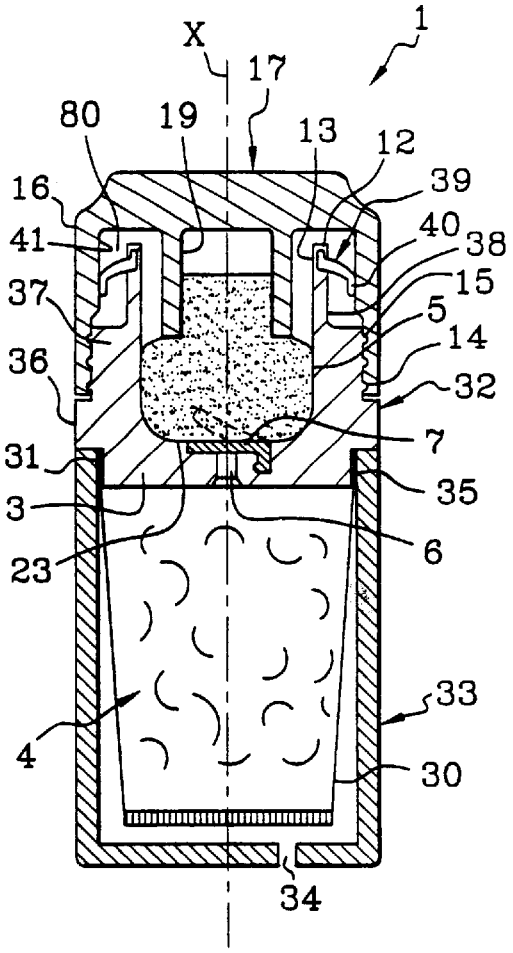
FIG. 2 is a cross-sectional view of a second embodiment of an assembly according to the present invention.

In the embodiment of FIG. 2, product P is contained inside a flexible-walled bag 30 defining reservoir 4. An open end 35 of bag 30 is mounted, preferably by welding, on an exterior surface 31 of a mounting piece 32 forming a part of the body of the device. Flexible-walled bag 30 is arranged inside a rigid chamber 33. An air intake orifice 34 is provided in a bottom portion of rigid chamber 33 to maintain chamber 33 at atomospheric pressure. Rigid chamber 33 may be snap-fastened onto mounting piece 32, for example, via a snap-fastening bulge (not depicted) or other suitable mechanism.

At an opposite end of bag 30, mounting piece 32 forms a skirt 11. The interior surface of skirt 11 delimits space 5, which is cylindrical over a substantial part of its height. The end of skirt 11 adjacent bag 30 is closed by a transverse wall 3 through which passes orifice 6 closed off by shutter valve 7, of the same type discussed with reference to the embodiment of FIGS. 1A–1C. A lower portion 36 of skirt 11 is aligned with outer chamber 33. An intermediate portion 37, the exterior cross-section of which is smaller than the cross-section of lower portion 36, includes screw thread 14 capable of engaging with corresponding screw thread 15 of cap 17. An upper portion 38 has a free edge defining opening 13 of space 5. Upper portion 38 has a cross-section smaller than the maximum cross-section of intermediate portion 37, so as to form, in conjunction with cap 17, an annular space 80.

Applicator portion 22 preferably is formed of a single block of an open-cell foam, a portion of which is mounted inside axial skirt 19 borne by cap 17. The applicator is preferably of such a size that, when the cap 17 is screwed on, applicator portion 22 is at least partially compressed inside space 5 so that application surface 23 presses elastically against the bottom of space 5.

On an exterior surface of upper portion 38 of skirt 11 rests an annular lip 39. which forms a piston moveable in annular space 80. Lip 39 is oriented in such a way that, in the absence of increased pressure inside space 5, its free edge 40 rests in a sealed fashion against a corresponding inner surface 41 of lateral skirt 16 of cap 17. In the event of a raised pressure inside space 5, particularly when cap 17 is closed, free edge 40 of lip 39 moves away from inner surface 41 of lateral skirt 16 and no longer is in sealed contact with surface 41. This allows air to escape under the free edge of skirt 16 of cap 17. For this purpose, lip 39 preferably is inclined towards the free edge of lateral skirt 16 of cap 17 and ends in a cylindrical resting surface 40 capable of engaging in a sealed fashion with cylindrical surface 41.

During use, cap 17 is unscrewed and pulled axially away from cylindrical body 2 to extract applicator 20 from space 5. In so doing, free edge 40 of lip 39 rests in sealed fashion against surface 41 of cap 17, thus causing a pressure decrease inside space 5. This pressure decrease causes shutter valve 7 to open and product P to be drawn into space 5 via orifice 6. As it decompresses, applicator 20 allows product P to be drawn out of reservoir 4 and into space 5 via orifice 6. The product is then applied in the way mentioned with reference to the embodiment of FIGS. 1A–1C by placing application surface 23 of applicator 20 in contact with the surface that is to be treated. After use and upon closure of cap 17, any air trapped in space 5 is driven to the outside by virtue of piston 39 and free edge 40 detaching from surface 41 of cap 17.

In a manner similar to the previous embodiment, during use, it is possible to reload the application surface 23 with product P without screwing cap 17 back on by axially oversizing applicator 20 with respect to the axial height of space 5.

Figure 3:
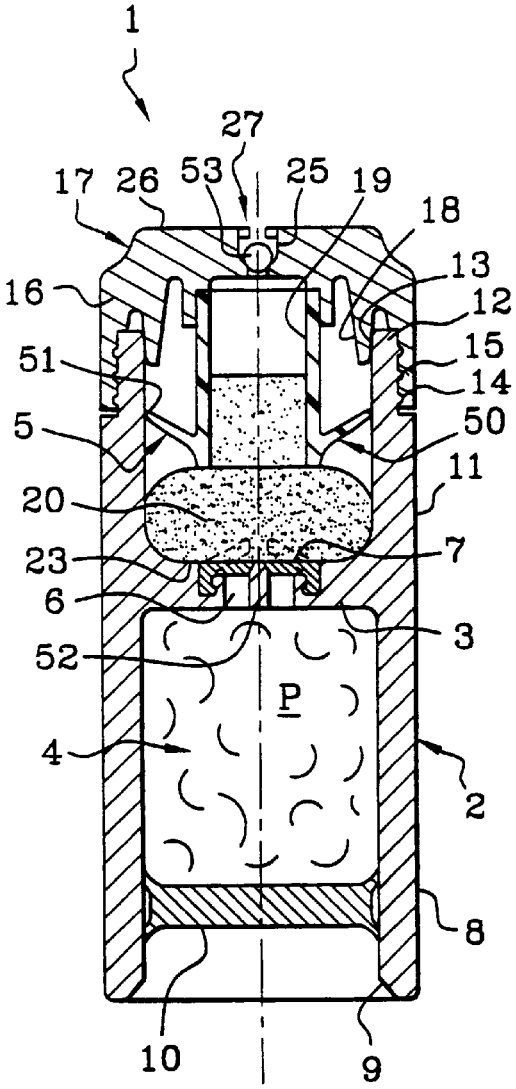
FIG. 3 is a cross-sectional view of a third embodiment of an assembly according to the present invention.

FIG. 3 is yet another embodiment of the dispensing assembly of the present invention. In this embodiment, applicator 20, including both portions 21 and 22, is formed as a single block of open-cell foam material, such as, for example, polyurethane or other suitable like material. The piston is formed by a lip 50, formed on the exterior surface of axial tube 19 of cap 17. A free edge 51 of lip 50 comes into sealed contact with the interior surface of skirt 11 of rigid cylindrical body 2. Axial tube 19 preferably is formed of an elastomeric material and may be overmolded or formed by two-shot injection molding with cap 17, which preferably is made of polypropylene or polyethylene, or other suitable like material. Alternatively, axial tube 19 may be attached mechanically by, for example, bonding, welding or snap-fastening, to stopper 17. Orifice 6 defined by transverse wall 3 is closed by shutter valve 7 which closes down onto a central seat 52 formed by transverse wall 3. Vent shutter valve 27 is of the type comprising a ball 53 mounted in an orifice 25 of cap 17. Air is conveyed from space 5 through the pores of applicator 20 and through orifice 25 to the atmosphere.

The way in which the assembly according to this embodiment works is essentially the same as was described with reference to the description of the workings of the embodiment of FIGS. 1A–1C.

Figure 4:
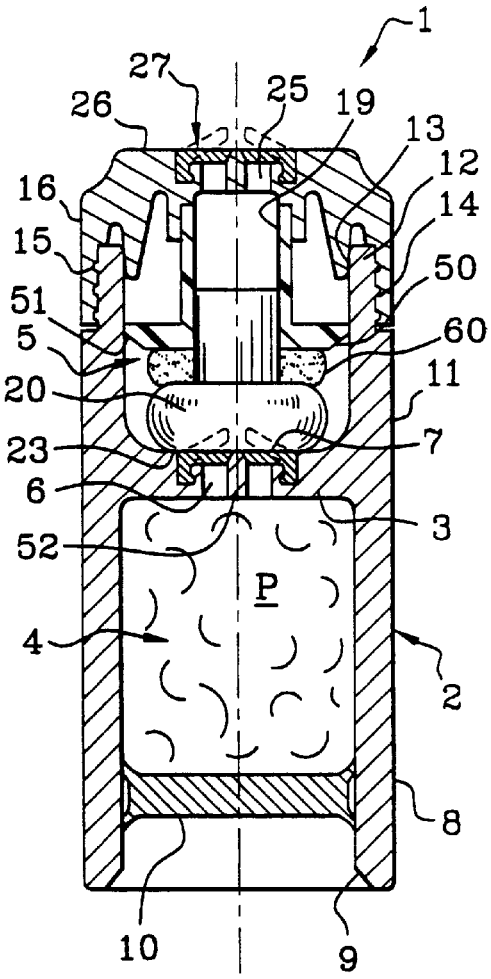
FIG. 4 is a cross-sectional view of a fourth embodiment of an assembly according to the present invention.

Yet another embodiment of the present invention is shown in FIG. 4. In this embodiment, application surface 23 of applicator 20 is made of a rigid porous material, preferably in the form of a ceramic frit. Application surface 23 of applicator 20 rests elastically against the bottom of space 5 via a compressible element 60 made of, for example, synthetic rubber and arranged between piston 50 and applicator member 20. Shutter valve 27, which selectively closes vent passage 25, is of similar structure as shutter valve 7 separating reservoir 4 from space 5.

The way in which the embodiment of FIG. 4 works is essentially the same as the embodiment of FIG. 3. When cap 17 is fitted onto the assembly, application surface 23 of applicator 20 rests elastically against the bottom of space 5 by virtue of the presence of a compressible element 60 which, in the position shown, is at least partially compressed. Upon opening cap 17, the compressible element 60 gradually decompresses, thus extending the time period for which application surface 23 is in communication with product P coming out of orifice 6 and into space 5.

Figure 5A:
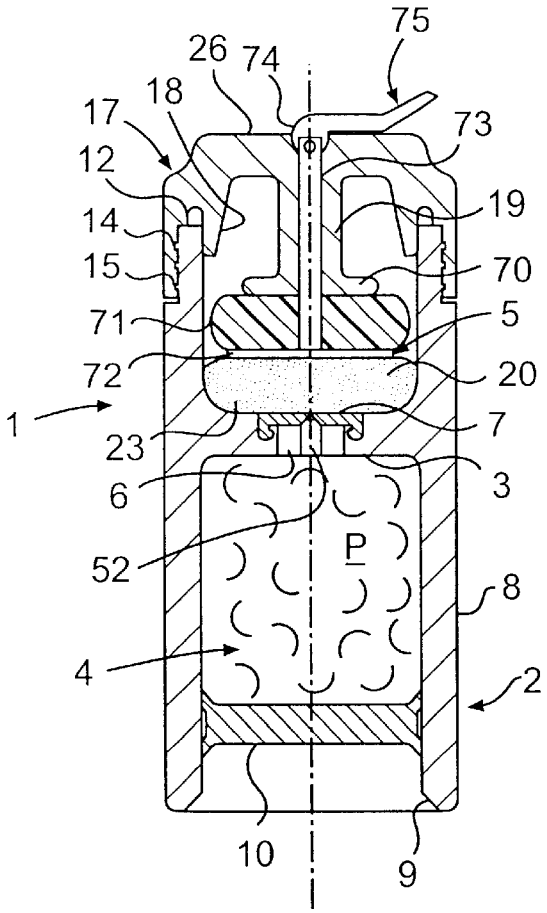
FIGS. 5A–5B is a cross-sectional view of a fifth embodiment of an assembly according to the present invention.
Figure 5B:
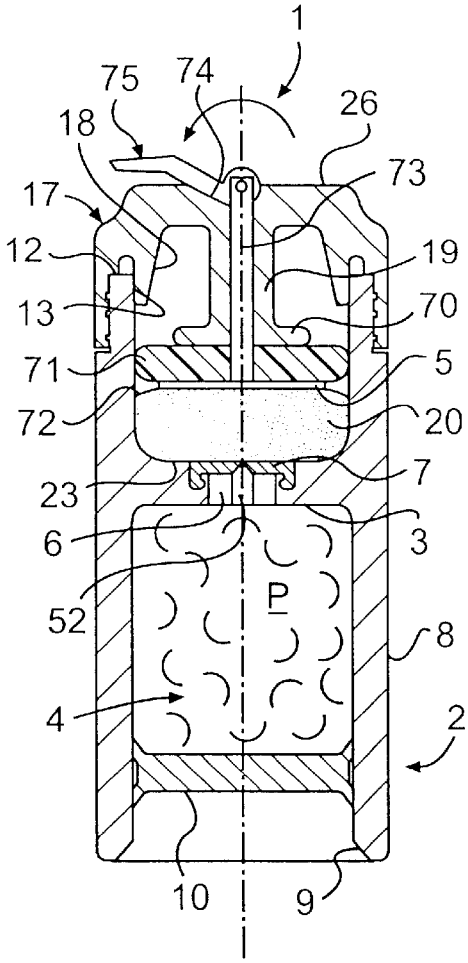

In the embodiment of FIGS. 5A–5B, axial tube 19 ends in a transverse flange 70, the axial position of which is fixed. Adjacent to flange 70 is an element 71, preferably made of an elastomeric material that can be deformed by compression, and selectively acting as a piston. Element 71 preferably may be in the form of a hollow torus-shaped element. Element 71 is arranged between flange 70 and a second flange 72. Second flange 72 is connected to an axially mobile rod 73 and to a handle 75 having a cam surface 74. The position of handle 75 with respect to surface 26 of cap 17 determines the axial position of flange 72 and thereby the amount of axial compression on element 71 forming the piston.

In the position shown in FIG. 5A, compressible element 71 remains relatively uncompressed. Its exterior cross-section is smaller than the interior cross-section of space 5 so that by axially shifting cap 17, for instance, upon opening or upon closure, piston 71 cannot come to rest in a sealed fashion against the interior surface defining space 5. This position corresponds to a position in which piston 71 is disengaged.

In the position shown in FIG. 5B, compressible element 71 is relatively extensively compressed. Its exterior cross-section is slightly greater than the interior cross-section of space 5 so that by shifting cap 17 axially, for instance, upon opening or upon closure, piston 71 moves in a sealed fashion along the interior surface defining space 5. This position corresponds to a position in which piston 71 is engaged. The difference in cross-section of piston 71 between the disengaged position and the engaged position may be on the order of about 1 to several millimeters.

An applicator 20 is fixed to the surface of flange 72 opposite to piston 71. Applicator member 20 may include a compressible element, for example, an open-cell foam, or a rigid element, for example, a frit. In the latter instance, application surface 23 is made to rest elastically against orifice 6 formed in wall 3, essentially through the presence of compressible piston 71. A device involving a shutter valve (not depicted) may act as a vent when cap 17 is closed with the piston 71 in the engaged position. Alternatively, it may only be possible for closure to occur when piston 71 is in the disengaged position. In this case, it is possible to dispense with such a shutter valve.

To use the dispensing assembly of this embodiment, the user positions piston 71 in the engaged position of FIG. 5B. By unscrewing cap 17 and pulling it away from the assembly axially, element 71 acts as a piston. Thus, the pressure decreases inside space 5 with respect to reservoir 4, causing a dose of product P to be forced from reservoir 4 into space 5 and onto application surface 23 of applicator 20. Application to the surface that is to be treated is achieved in the same way as in the other embodiments. If, during use, it is necessary to reload the application surface 23, and if enough excess product remains in the bottom of space 5, then the user disengages piston 71 by positioning it in the disengaged position of FIG. 5A. The user may then dip applicator 20 back into space 5 so as to place application surface 23 back in contact with any product left in the bottom of space 5. Conversely, if no product remains in the bottom of space 5, the user may leave piston 71 in the engaged position of FIG. 5B and force a further dose of product from reservoir 4 into space 5 in the way indicated hereinabove.

Upon closing the device in order to store it, the user disengages piston 71 and screws cap 17 back onto assembly 1.

It will be understood that this disclosure, in many respects, is only illustrative. Changes may be made in details, particularly in matters of shape, size, material, number, and arrangement of parts without exceeding the scope of the invention.

For example, the materials used for the application surface and piston may be modified. Similarly, the piston arrangement within the space may be altered, so long as the motion of the piston generates the desired pressure difference between the space and the reservoir. Furthermore, although the embodiments described herein pertained to the dispensing of a cosmetic product, it is envisioned that other products can be dispensed with using the inventive assembly.

Other embodiments of the invention will be apparent to those skilled in the art from consideration of the specification and practice of the invention disclosed herein. It is intended for the specification and examples to be considered as examplary only, with a true scope and spirit of the invention being indicated by the following claims.

What is claimed is:

1. An assembly for dispensing a product, comprising:

a first portion defining a variable volume reservoir for containing the product, the reservoir decreasing in volume in response to removal of the product from the reservoir;

a second portion defining a space configured to removably receive an application member;

an application member configured to be removably received in the space;

a flow passage providing flow communication between the reservoir and the space;

a flow valve configured to selectively enable flow of the product from the reservoir to the space via the flow passage;

a removable cap on the second portion; and a piston configured to cause a pressure decrease in the space, wherein the valve opens in response to the pressure decrease in the space to enable flow of at least a portion of the product from the reservoir to the space via the flow passage.

2. The assembly of claim 1, wherein the cap is configured to seal the space when the cap is mounted on the second portion.

3. The assembly of claim 1, wherein the application member includes a porous element configured to absorb the product.

4. The assembly of claim 3, wherein the application member has an absorption capacity sufficient to enable absorption of the amount of product passing from the reservoir to the space in response to the pressure decrease caused by the piston.

5. The assembly of claim 3, wherein the porous element is formed from one of an open-cell foam, a semi-open cell foam, and a frit.

6. The assembly of claim 1, wherein the application member is provided on the cap, and wherein the piston is configured to cause the decrease in pressure when the cap is moved from a closed position to an open position.

7. The assembly of claim 6, wherein the piston is configured to be in either a disengaged position or an engaged position, such that in the disengaged position the piston does not cause a pressure decrease in the space when the cap is moved from the closed position to the open position, and in the engaged position the piston causes a pressure decrease in the space when the cap is moved from the closed position to the open position.

8. The assembly of claim 7, further comprising a selector configured to cause the piston to be selectively placed in one of the disengaged and engaged positions.

9. The assembly of claim 1, further comprising a vent passage configured to place the space in selective flow communication with the atmosphere to vent the space to atmospheric pressure when a pressure increase occurs in the space.

10. The assembly of claim 9, further comprising a one-way vent valve configured to establish the selective flow communication with the atmosphere via the vent passage.

11. The assembly of claim 10, wherein the one-way vent valve is one of a shutter valve and a ball valve.

12. The assembly of claim 1, wherein the space is defined at least in part by a cylinder in which the piston slides.

13. The assembly of claim 12, wherein the piston is made of a non-porous portion and includes the application member.

14. The assembly of claim 12, wherein the piston is provided on the application member on a side of the application member opposite to the flow passage.

15. The assembly of claim 12, wherein the piston defines a vent passage configured to vent the space to atmospheric pressure.

16. The assembly of claim 1, wherein an annular space is formed between the second portion and the cap when the cap is mounted on the second portion, said annular space being in flow communication with the space and the piston being disposed in the annular space.

17. The assembly of claim 16, wherein the piston includes a sealing lip provided on the second portion, the sealing lip being configured to slide against an interior surface of the cap when the cap is opened.

18. The assembly of claim 17, wherein the piston is configured to be in a sealed relationship with the interior surface of the cap when the pressure decrease occurs in the space and in an unsealed relationship with the interior surface of the cap when a pressure increase occurs in the space, said unsealed relationship allowing the space to be vented to atmospheric pressure.

19. The assembly of claim 1, wherein the first and second portions are provided on a rigid body including a transverse wall defining said flow passage.

20. The assembly of claim 19, wherein the body includes a skirt at least partially defining the space, said skirt having a free edge which delimits an opening.

21. The assembly of claim 20, wherein the skirt includes a screw thread configured to engage with a corresponding screw thread on the cap.

22. The assembly of claim 21, wherein the piston is disposed outside of the skirt and is secured to the skirt.

23. The assembly of claim 20, wherein the reservoir is disposed on a side of the transverse wall opposite to the skirt.

24. The assembly of claim 23, wherein the body includes a second skirt defining at least a portion of the reservoir, said second skirt including a free edge disposed at an end of the assembly opposite to the space.

25. The assembly of claim 24, further comprising a follower piston slidably mounted in the second skirt.

26. The assembly of claim 24, wherein the free edge of the second skirt defines an opening which is closed by a deformable diaphragm.

27. The assembly of claim 23, wherein the reservoir is formed of a bag including at least one flexible wall mounted on the body and configured to collapse as product is removed from the reservoir.

28. The assembly of claim 27, wherein the bag is disposed inside one of a rigid chamber and a semi-rigid chamber.

29. The assembly of claim 28, wherein a space defined between the chamber and the bag is in flow communication with the atmosphere.

30. The assembly of claim 1, wherein the application member is formed at least in part from a material chosen from a foam of polyether, polyester, polyurethane, natural butadiene rubber, synthetic butadiene rubber, polyvinyl chloride, latex or silicone or from a frit of polyethylene, nylon, bronze, or glass.

31. The assembly of claim 1, wherein the application member rests elastically against the flow passage when the cap is closed.

32. The assembly of claim 31, wherein the application member is made of a material which is relatively incompressible and wherein an elastically compressible element is arranged between the porous element and the piston.

33. The assembly of claim 1, wherein the flow valve is a one-way valve.

34. The assembly of claim 33, wherein the flow valve is one of a shutter valve and a ball valve.

35. The assembly of claim 1, further comprising a cosmetic product contained in the reservoir.

36. A method of dispensing a cosmetic product using the assembly of claim 1, wherein the reservoir is provided with the cosmetic product to be dispensed, comprising actuating the piston to cause the pressure decrease in the space to enable flow of at least a portion of the cosmetic product from the reservoir into the space via the flow passage.

37. The method of claim 36, further comprising providing an application member within the space and loading the application member with the cosmetic product as the product flows from the reservoir to the space.

38. A dispensing assembly for dispensing a product, comprising:

a first portion defining a reservoir configured to contain the product prior to dispensing;

a second portion defining a space and an opening enabling access to the space, said space being in selective flow communication with the reservoir;

a cap configured to be removably mounted on the second portion to sealably cover the opening; and an actuator configured to selectively cause a pressure difference between the reservoir and the space in response to removal of the cap from the second portion, wherein the pressure difference causes the product to flow from the reservoir to the space.

39. The assembly of claim 38, further comprising a one-way valve disposed between the reservoir and the space, the one-way valve being configured to selectively establish the flow communication between the reservoir and the space.

40. The assembly of claim 38, wherein the actuator includes a piston slidably mounted in the second portion.

41. The assembly of claim 40, wherein the volume of the space changes as a position of the piston in the second portion changes.

42. The assembly of claim 41, wherein as the volume of the space increases, the pressure of the space decreases causing the product to be drawn from the reservoir to the space.

43. The assembly of claim 41, wherein as the volume of the space decreases, the pressure of the space increases thereby establishing flow communication between the space and the environment surrounding the assembly.

44. The assembly of claim 38, further comprising a removable application member disposed in the space, said application member being configured to receive product as it is forced from the reservoir to the space.

45. The assembly of claim 44, wherein the application member is provided on the actuator.

46. The assembly of claim 44, wherein the application member is made at least in part of a porous material configured to absorb the product.

47. The assembly of claim 46, wherein the application member is configured to be in selective flow communication with a vent passage that opens to the environment surrounding the assembly, said selective flow communication being established by an increase in pressure in the space as compared to the pressure of the environment surrounding the assembly.

48. The assembly of claim 38, further comprising a vent passage selectively communicating the space with the atmosphere.

49. The assembly of claim 48, further comprising a one-way vent valve configured to selectively permit flow from the space to the atmosphere via the vent passage.

50. The assembly of claim 38, further comprising an application member on the cap.

51. The assembly of claim 38, wherein the reservoir and the space have variable volumes.

52. The assembly of claim 38, wherein the reservoir has a volume that decreases as product is forced from the reservoir to the space.

53. A method for dispensing a product, comprising:

providing an assembly defining a reservoir containing the product, a space in selective flow communication with the reservoir, an opening permitting access to the space, a removable cap configured to sealably close the opening, and an actuator;

removing the cap to permit access to the opening;

actuating the actuator to cause a pressure difference between the reservoir and the space; and causing the product to flow from the reservoir to the space as a result of the pressure difference.

54. The method of claim 53, wherein the actuator is a piston slidably disposed relative to the space.

55. The method of claim 54, wherein the actuating includes varying the volume of the space by moving the piston.

56. The method of claim 55, wherein the movement of the piston increases the volume of the space and decreases the pressure in the space, thereby causing the product to flow from the reservoir to the space.

57. The method of claim 56, further comprising moving the piston so as to decrease the volume of the space and increase the pressure in the space, thereby establishing flow communication between the space and the environment surrounding the assembly.

58. The method of claim 57, wherein the moving of the piston to decrease the volume of the space causes a valve to open to establish the flow communication between the space and the environment surrounding the assembly.

59. The method of claim 53, wherein the removing of the cap actuates the actuator.

60. The method of claim 53, comprising providing an application member removably disposed within the space and configured to receive the product forced from the reservoir to the space.

61. An assembly for dispensing a product, comprising a first portion defining a reservoir containing the product to be dispensed;

a second portion defining a space in selective flow communication with the reservoir;

an application member for applying the product to a surface, said application member being removably disposed in the space, the application member being configured such that removal of the application member from the space induces flow of the product from the reservoir to the space, thereby permitting the application member to receive the product.

62. The assembly of claim 61, wherein removal of the application member from the space causes a pressure difference between the space and the reservoir.

63. The assembly of claim 62, further comprising a flow valve disposed between the reservoir and the space, said flow valve opening in response to the pressure difference caused by removal of the application member.

64. The assembly of claim 61, wherein the application member is provided on a piston, said piston being configured to slidably engage with said second portion to define said space.

65. The assembly of claim 64, wherein removal of the application member moves the piston, thereby increasing the volume of the space to cause a pressure decrease in the space with respect to the reservoir.

66. An assembly for dispensing a product, comprising:

a first portion defining a variable volume reservoir for containing the product, the reservoir decreasing in volume in response to removal of the product from the reservoir;

a second portion defining a space configured to removably receive an application member;

a flow passage providing flow communication between the reservoir and the space;

a flow valve configured to selectively enable flow of the product from the reservoir to the space via the flow passage;

a removable cap on the second portion;

a vent passage configured to place the space in selective flow communication with the atmosphere to vent the space to atmospheric pressure when a pressure increase occurs in the space; and a piston configured to cause a pressure decrease in the space, wherein the valve opens in response to the pressure decrease in the space to enable flow of at least a portion of the product from the reservoir to the space via the flow passage.

67. An assembly for dispensing a product, comprising:

a first portion defining a variable volume reservoir for containing the product, the reservoir decreasing in volume in response to removal of the product from the reservoir;

a second portion defining a space configured to removably receive an application member;

a flow passage providing flow communication between the reservoir and the space;

a flow valve configured to selectively enable flow of the product from the reservoir to the space via the flow passage;

a removable cap on the second portion; and a piston configured to cause a pressure decrease in the space, wherein the valve opens in response to the pressure decrease in the space to enable flow of at least a portion of the product from the reservoir to the space via the flow passage, wherein the space is defined at least in part by a cylinder in which the piston slides, and wherein the piston defines a vent passage configured to vent the space to atmospheric pressure.

68. An assembly for dispensing a product, comprising:

a first portion defining a variable volume reservoir for containing the product, the reservoir decreasing in volume in response to removal of the product from the reservoir;

a second portion defining a space configured to removably receive an application member;

a flow passage providing flow communication between the reservoir and the space;

a flow valve configured to selectively enable flow of the product from the reservoir to the space via the flow passage;

a removable cap on the second portion; and a piston configured to cause a pressure decrease in the space, the piston including a sealing lip provided on the second portion, the sealing lip being configured to slide against an interior surface of the cap when the cap is opened, wherein the valve opens in response to the pressure decrease in the space to enable flow of at least a portion of the product from the reservoir to the space via the flow passage, and wherein an annular space is formed between the second portion and the cap when the cap is mounted on the second portion, said annular space being in flow communication with the space and the piston being disposed in the annular space.

* * * * *